United States Patent [19]

Wycliffe

[11] Patent Number: 4,504,201

[45] Date of Patent: Mar. 12, 1985

[54] MECHANICAL PUMPS

[75] Inventor: Henryk Wycliffe, Crawley, England

[73] Assignee: The BOC Group plc, London, England

[21] Appl. No.: 443,506

[22] Filed: Nov. 22, 1982

[51] Int. Cl.[3] ..... F01C 1/30

[52] U.S. Cl. ..... 418/3; 418/9; 417/252

[58] Field of Search ..... 418/3, 9, 191; 417/252

[56] References Cited

U.S. PATENT DOCUMENTS

| | | | |
|---|---|---|---|
| 3,084,851 | 4/1963 | Schibbye et al. | 418/9 |
| 3,272,130 | 9/1966 | Mosbacher | 418/9 |
| 4,059,368 | 11/1977 | McGahan | 418/9 |
| 4,224,016 | 9/1980 | Brown | 418/191 |
| 4,324,538 | 4/1982 | Brown | 418/191 |

FOREIGN PATENT DOCUMENTS

| | | | |
|---|---|---|---|
| 35819 | 3/1968 | Japan | 418/9 |
| 50294 | 5/1981 | Japan | 418/9 |
| 596064 | 12/1947 | United Kingdom | 418/9 |
| 2088957 | 6/1982 | United Kingdom | 418/3 |
| 472207 | 9/1975 | U.S.S.R. | 418/9 |

*Primary Examiner*—William L. Freeh

*Attorney, Agent, or Firm*—David A. Draegert; Larry R. Cassett

[57] ABSTRACT

A mechanical pump includes a pumping chamber through which extends a pair of parallel shafts 3. Each shaft 3 carries in tandem rotors 4, 5 and 6 at least two of which are the intermeshing "claw" type. The rotors are arranged in complementary pairs and each pair occupies a separate location in the pumping chamber. Each "claw" type rotor 6 of a complementary pair in one location is mounted on its shaft 3 in reverse orientation to the "claw" type rotors 5 of the complementary pairs in the adjacent location.

9 Claims, 8 Drawing Figures

MECHANICAL PUMPS

The present invention relates to mechanical pumps, and in particular, to large, oil free, high vacuum mechanical pumps.

In a number of industries, for example, the food processing industry, it is essential that air and other gases delivered by mechanical pumps or compressors are oil and particle free.

In order to improve the efficiency of such pumps, it is known for multistage pumps to include at the output stage and the stage immediately adjacent the output stage, rotors of the intermeshing "claw" type. Such multistage pumps have considerable gas transfer volumes and re-expansion into the swept volume of the preceeding stage can occur unless prevented from doing so by an interstage non return valve. However, such valves are disadvantageous in that they tend to complicate the pump design.

It is an aim of the present invention to provide a mechanical pump which is efficient in that it can attain a high vacuum commensurate with low power input and is of relatively simple design in that it requires no interstage non return valves.

According to the present invention, a mechanical pump comprises a pumping chamber having an inlet and an outlet for the passage therethrough of fluid to be pumped, a pair of shafts extending through the pumping chamber, each shaft supporting for rotary movement therewith in tandem at least two rotors of the intermeshing "claw" type, each rotor forming one of a complementary pair, each complementary pair occupying an individual location in the pumping chamber, adjacent locations being separated by a partition, each rotor of the complementary pair in one location being mounted on its shaft in reverse orientation to the rotors of this complementary pair in the adjacent location.

An advantage of the mechanical pump as defined above, is that by arranging the pairs of rotors in adjacent stages or locations in a reverse orientation, this allows a direct transfer of gas from one stage to the next through a transfer port in the partition wall separating the adjacent locations or stages with minimal interstage volume. The outlet of one stage on one side of the interstage partition becomes the inlet of the next stage on the other side of the partition.

An embodiment of the invention will now be described, by way of example, reference being made to the figures of the accompanying diagrammatic drawings in which.

Figure 1:
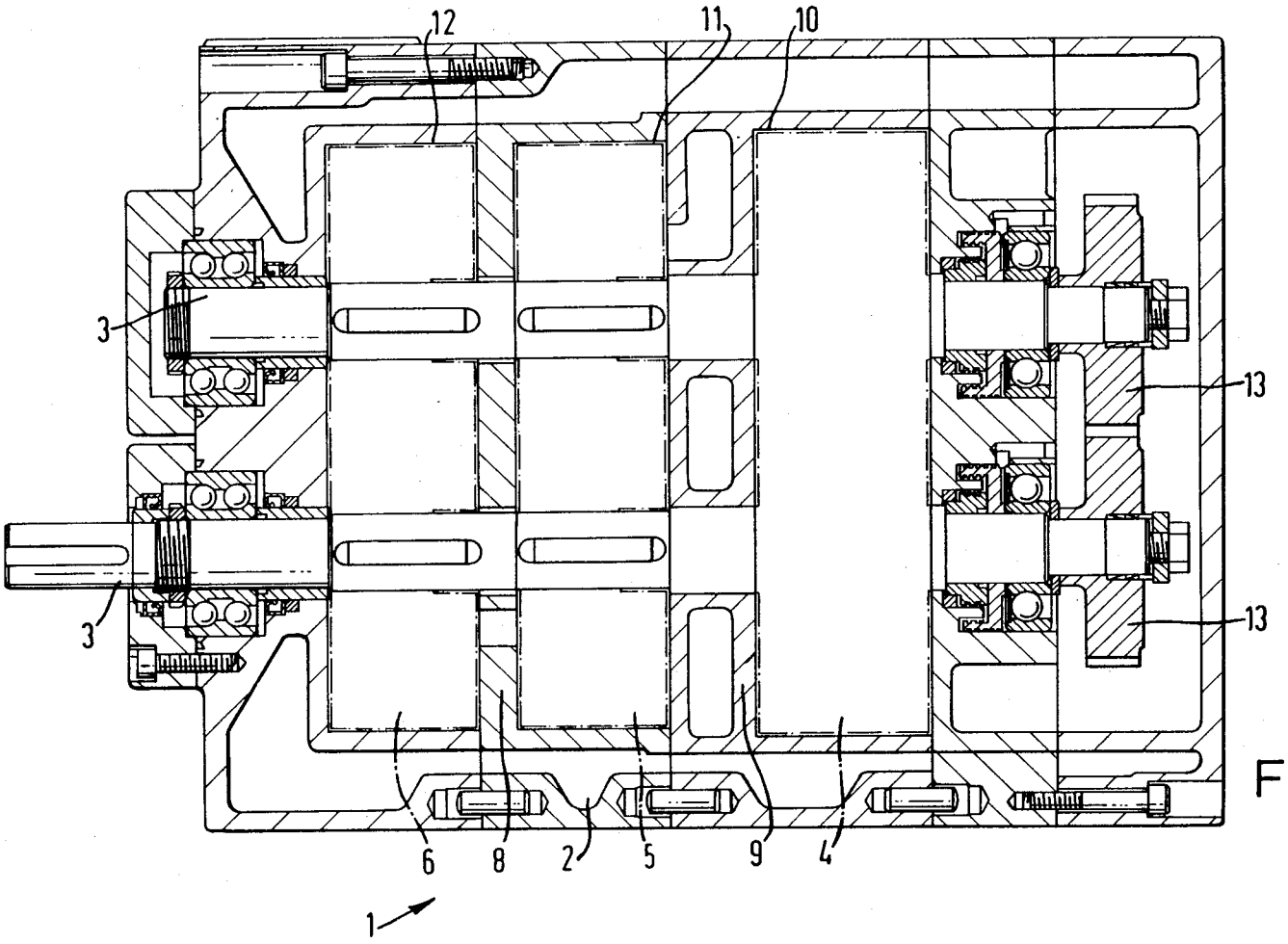
FIG. 1 is a longitudinal cross-section through a mechanical pump.

As shown in FIG. 1, a mechanical pump 1 includes a pumping chamber 2 through which pass a pair of parallel shafts 3. Each shaft 3 supports for rotation therewith, three rotors 4, 5, and 6. The rotors 4, 5 and 6 are arranged in complementary pairs and the pairs are arranged in tandem on their respective shafts 3. The pumping chamber 2 is divided by partitions 8, 9 into three spaced locations, 10, 11 and 12, each occupied by a pair of rotors.

At its right hand end (as shown), each shaft 3 carries a timing gear 13, and at its left hand end (as shown) one shaft 3 is drivable by a motor via a fluid coupling, (not shown) in a manner known in the art.

Figure 3:
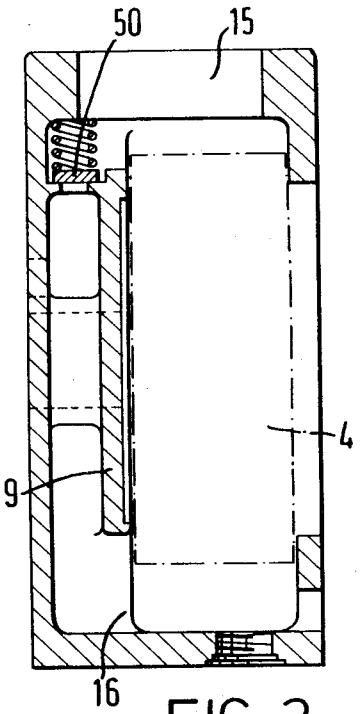
FIG. 3 is a section on the line A—A in FIG. 2.
Figure 2:
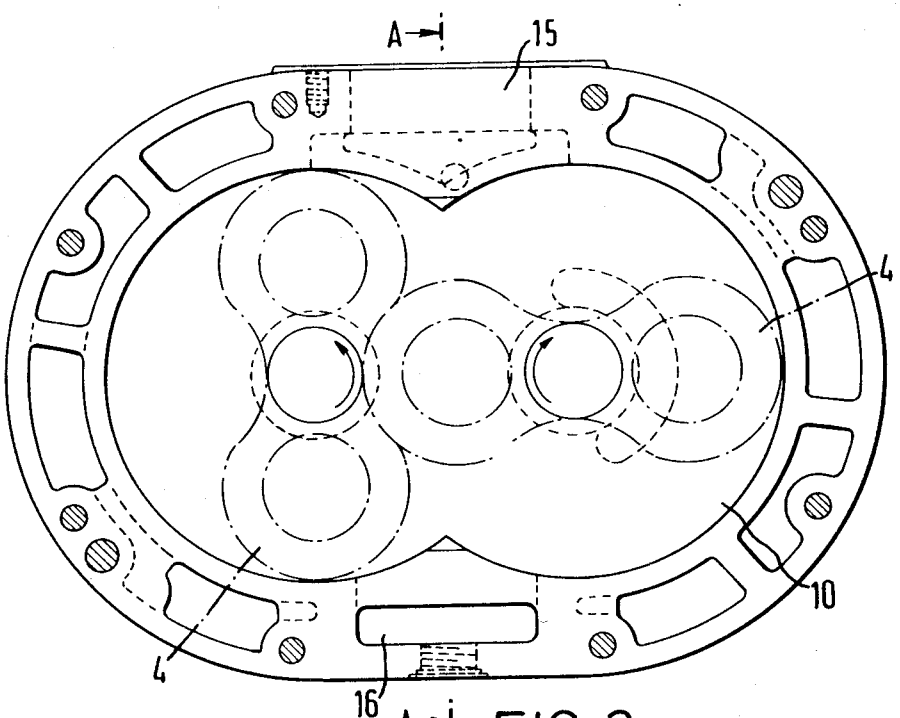
FIG. 2 is a transverse cross-section through the first or inlet stage of the mechanical pump of FIG. 1.

Referring also to FIGS. 2 and 3, the rotors 4 at location 10 are of the figure-of-8 or Roots-type, and form part of the first or inlet stage of the multistage pump 1.

The profile of the rotors 4 ensure that they have "minimal carry over" volume. By this is meant that the profiles of the co-operating rotors 4 are such that during their inter action the volume of gas trapped on the exhaust side of the rotors which is carried back to the inlet side of the rotors is kept to a practical minimum. This is important since if pockets of gas are carried over from the exhaust to the inlet side of the rotors, said pockets of gas will tend to expand and reduce the volumetric efficiency of the pump.

An inlet 15 to the pumping chamber 2 is provided, which as shown communicates with location 10, and an outlet 16 from the location 10 or inlet stage is provided in partition 9.

A bypass valve 50 is provided at the input stage for a reason which will be explained later.

Referring also to FIGS. 4 to 8, the rotors 5 and 6 at locations 11 and 12 respectively are of the intermeshing "claw" type. Rotors 5 at the location 11 form the second or intermediate stage of the multistage pump 1, whilst the rotors 6 at location 12 form the third or outlet stage of pump 1.

Figure 4:
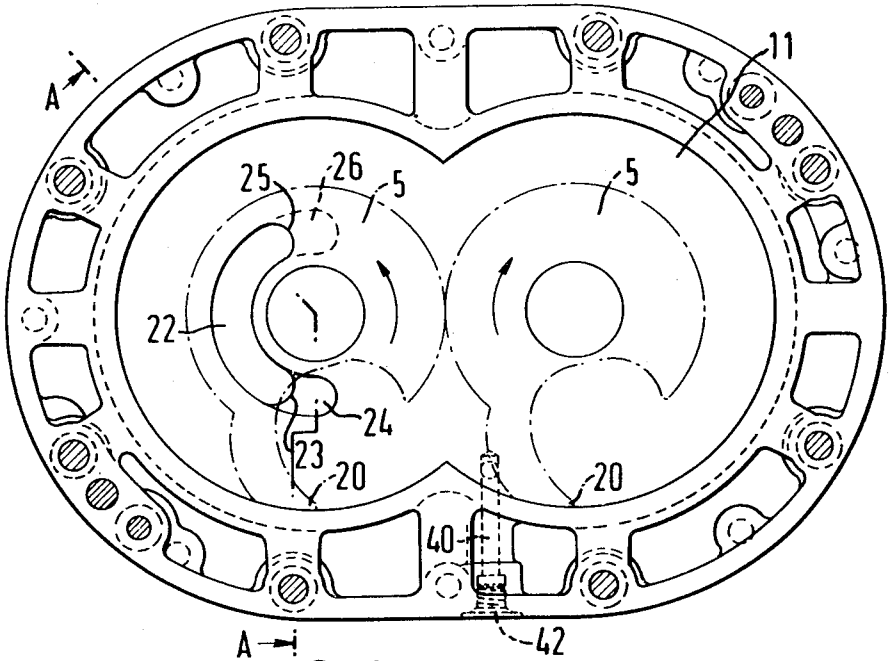
FIG. 4 is a transverse cross-section through the intermediate stage of the mechanical pump of FIG. 1.
Figure 7:
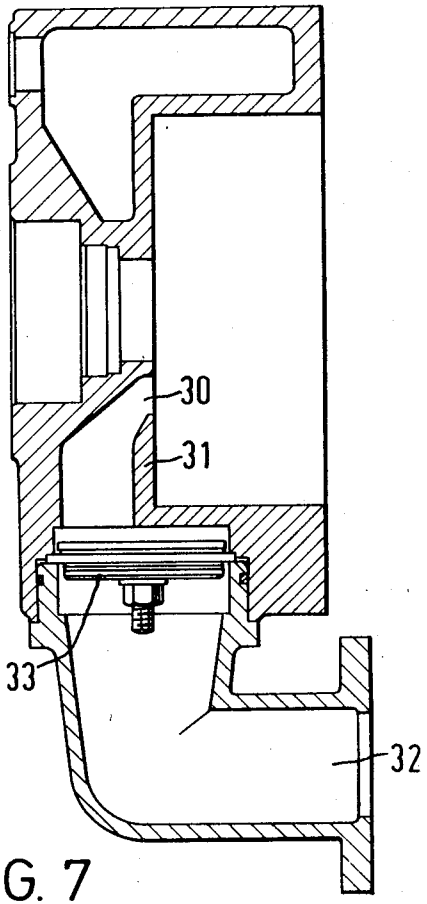
FIG. 7 is a cross section on the line A—A of FIG. 6.
Figure 6:
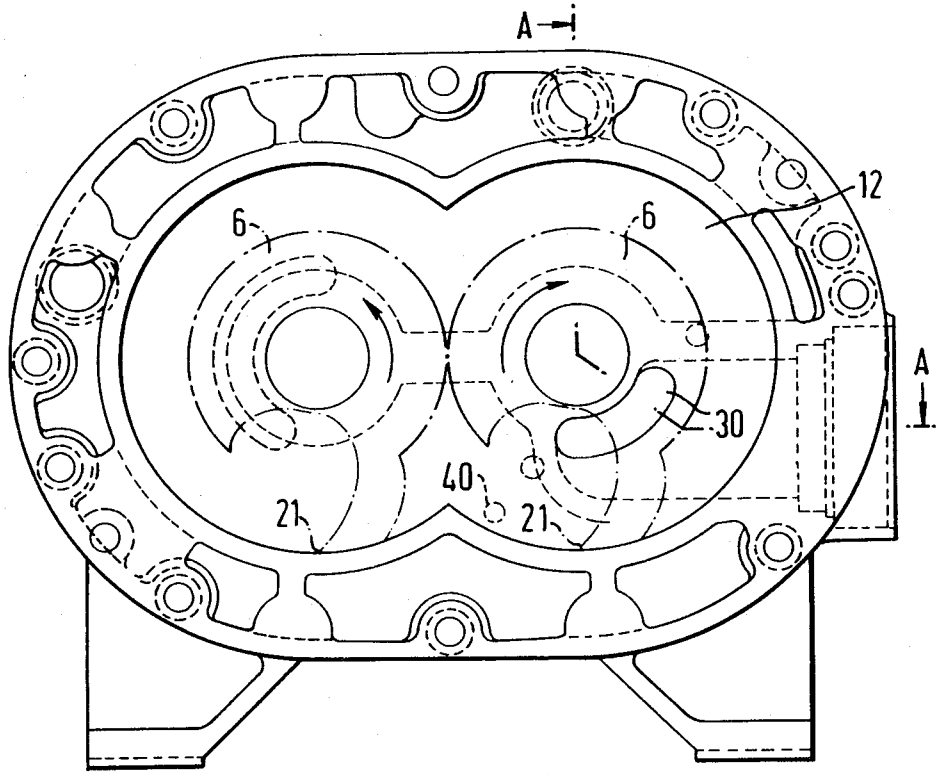
FIG. 6 is a transverse cross-section through the final or outlet stage of the mechanical pump of FIG. 1.
Figure 8:
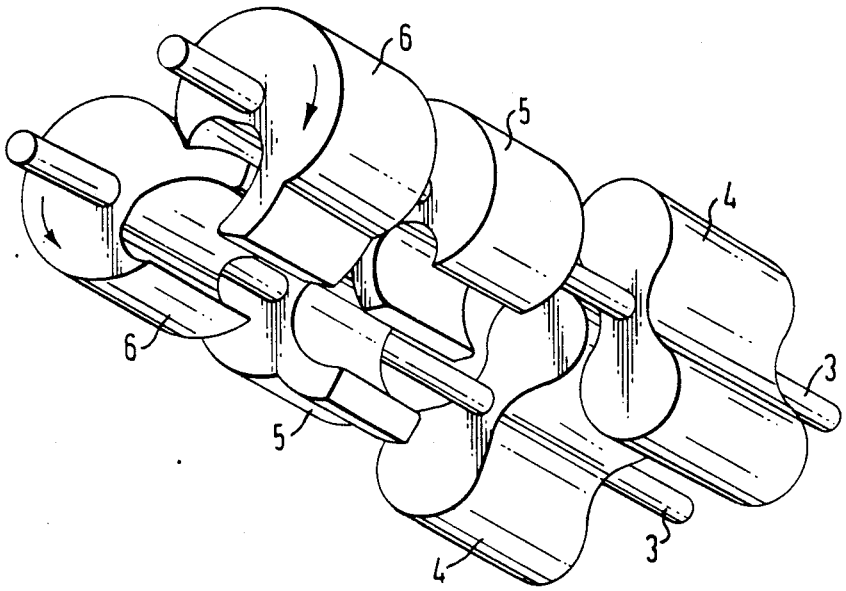
FIG. 8 is a perspective view illustrating the relationship between the rotors forming part of the inlet, intermediate and output stages of the mechanical pump of FIG. 1.

It will be observed that the orientation of rotors 5 is such that the tip 20 of each rotor claw points towards the right as shown in FIG. 4, whilst the orientation of rotors 6 is such that the tip 21 of each rotor claw points to the left as shown in FIG. 6. In other words the orientation of rotors 6 is reversed as compared to the orientation of rotors 5.

Figure 5:
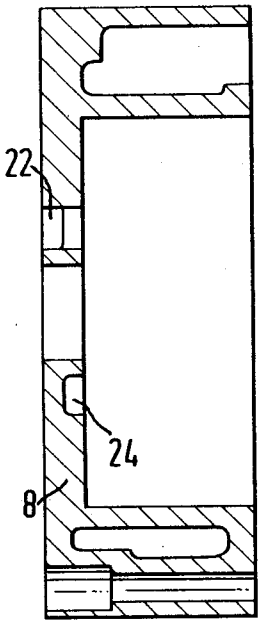
FIG. 5 is a cross-section on the line A—A of FIG. 4.

The partition 8 dividing the intermediate and output stages is formed with an arcuate slot 22 which forms, in part, the outlet from the intermediate stage and, in part, the inlet to the output stage. The through slot 22 is stepped at 23 to form a channel 24 on the right hand surface of the partition (as shown in FIG. 5). Similarly the slot 22 is stepped at 25 to form a channel 26 on the left hand side of partition 8. The channel 26 and slot 22 form the inlet to the outlet stage.

An outlet 30 is provided from the outlet stage and is in the form of an arcuate slot in an end wall 31 defining with the partition 8, the location 12. The outlet 30 communicates via a one-way valve 33, with an outlet 32 from the pump 1.

Also, in partition 8, there is a conduit 40 which leads from an inlet 42 to the output stage. The inlet 42 is a connection for the admission of air ballast.

In operation, when a motor drives one shaft 3, by means of the timing gears 13, both shafts 3 will be driven in synchronisation thereby driving the various pairs of rotors synchronously.

Fluid to be pumped will enter the inlet 15 into the inlet stage where it will be pumped and exit via outlet 16 to the intermediate stage. At the intermediate stage it will be further pumped and will exit via slot 22 into the final outlet stage where it will exit via outlet 30 non-return valve 33 and outlet 32.

When the pump 1 is used in a high vacuum application, the swept volume of the rotors 6 is mainly at low pressure, and gases which exit from the outlet 32 will tend to re-enter the swept volume unless prevented from doing so by the non return valve 33.

The connection 42 permits the introduction of air ballast into the swept volume of the outlet stage when it is isolated from its inlet. When pumping vapour, the air ballast is compressed with the vapour and so permits delivery of the air/vapour mixture to atmosphere before the vapour is liquified. Furthermore, air ballast can also be used to displace hot gases from the outlet side of the swept volume of the outlet stage.

The bypass valve 50 is mounted in the first stage, since the first stage is often of larger displacement than the intermediate and output stage.

The bypass valve 50 is operative to avoid excessive inter stage pressure build up.

The pump as described above is free from non return valves in the partitions dividing the various locations or stages of the pump. By reversing the orientation of the two pairs of intermeshing claw type rotors, this permits transfer of gas from one stage to the next through a transfer port in the interstage partition with minimal interstage volume. In effect, the output of one stage, becomes the inlet of the next adjacent stage.

I claim:

1. A mechanical pump comprising a pumping chamber having an inlet and an outlet for the passage therethrough of a compressable fluid to be compressed and pumped; a pair of parallel shafts extending through the pumping chamber, each shaft supporting for rotary movement therewith in tandem at least two rotors of the intermeshing "claw" type, each rotor forming one of a complementary pair, each complementary pair occupying an individual location in the pumping chamber, adjacent locations being separated by a partition having an opening which permits the passage of the compressable fluid directly from one location to the next adjacent location, each rotor of the complementary pair in one location being mounted on its shaft in reverse orientation to the rotors of the complementary pair in the adjacent location.

2. A mechanical pump as claimed in claim 1 in which the opening which permits the passage of fluid from one location to the next adjacent location is an arcuate slot.

3. A mechanical pump as claimed in claim 2, in which a one way valve is positioned at the outlet from the pumping chamber to control the passage of fluid through said outlet.

4. A mechanical pump as claimed in any one of claims 1 to 3, in which means is provided for the admission of air ballast to the location in the pumps immediately adjacent to the outlet from the pumping chamber.

5. A mechanical pump as claimed in any one of claims 1 to 3 in which the pump exhausts to the atmosphere.

6. A mechanical pump as claimed in any one of claims 1 to 3, in which a further rotor is mounted on each shaft in tandem with said at least two rotors, said further rotor being of the Roots type and forming one of a complementary pair occupying a location immediately adjacent the inlet to the pumping chamber.

7. A mechanical pump as claimed in claim 6, in which means is provided for the admission of air balast to the location in the pump immediately adjacent to the outlet from the pumping chamber and the pump exhausts to the atmosphere.

8. A mechanical pump as claimed in claim 6, in which a bypass valve is positioned in the location occupied by the pair of Roots type rotors.

9. A mechanical pump as claimed in claim 8, in which means is provided for the admission of air balast to the location in the pump immediately adjacent to the outlet from the pumping chamber and the pump exhausts to the atmosphere.

* * * * *